US009010580B2

(12) United States Patent
Rolek

(10) Patent No.: US 9,010,580 B2
(45) Date of Patent: Apr. 21, 2015

(54) STREAM DETECTION AND/OR CHARACTERIZATION FOR BEVERAGE DISPENSING IN A REFRIGERATOR

(75) Inventor: Robert J. Rolek, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 452 days.

(21) Appl. No.: 12/915,083

(22) Filed: Oct. 29, 2010

(65) Prior Publication Data

US 2012/0103071 A1 May 3, 2012

(51) Int. Cl.

| | |
|---|---|
| ***B67D 7/80*** | (2010.01) |
| ***F25D 23/12*** | (2006.01) |
| *F25D 29/00* | (2006.01) |

(52) U.S. Cl.

CPC ..... *F25D 23/126* (2013.01); *F25D 29/00* (2013.01); *F25D 2400/36* (2013.01)

(58) Field of Classification Search

USPC ..... 222/131, 146.6, 183; 62/389, 264, 125, 62/127, 129; 141/94, 95, 96, 198; 340/552, 555, 556; 239/63; 700/244; 73/61.48

See application file for complete search history.

(56) References Cited

U.S. PATENT DOCUMENTS

| | | | | |
|---|---|---|---|---|
| 3,322,957 | A * | 5/1967 | Scoggin | 250/573 |
| 5,450,882 | A * | 9/1995 | Cragun | 141/9 |
| 5,452,076 | A | 9/1995 | Schopper et al. | |
| 5,559,339 | A * | 9/1996 | Domanik et al. | 250/573 |
| 6,374,845 | B1 * | 4/2002 | Melendez et al. | 137/3 |
| 6,617,079 | B1 * | 9/2003 | Pillion et al. | 430/3 |
| 6,672,200 | B2 | 1/2004 | Duffy et al. | |
| 6,681,585 | B1 | 1/2004 | Stagg et al. | |
| 6,766,656 | B1 * | 7/2004 | Crisp et al. | 62/389 |
| 6,924,499 | B2 | 8/2005 | Poisel et al. | |
| 7,168,592 | B2 * | 1/2007 | Crisp et al. | 222/129.1 |
| 8,109,301 | B1 * | 2/2012 | Denise | 141/360 |
| 2003/0060994 | A1 * | 3/2003 | Deng et al. | 702/105 |
| 2005/0178273 | A1 | 8/2005 | Meuleners et al. | |
| 2008/0000357 | A1 | 1/2008 | Yang et al. | |
| 2008/0035666 | A1 * | 2/2008 | Porras et al. | 222/1 |
| 2008/0168791 | A1 | 7/2008 | Nebbia et al. | |

FOREIGN PATENT DOCUMENTS

| | | | | |
|---|---|---|---|---|
| GB | 2448082 | A * | 10/2008 | G01N 33/14 |

* cited by examiner

*Primary Examiner* — Patrick M Buechner

(57) ABSTRACT

A refrigerator includes a refrigerator cabinet and a refrigerating compartment within the refrigerator cabinet. A beverage dispensing system is operatively connected to the refrigerator cabinet, the beverage dispensing system configured to dispense a stream of a beverage. The beverage dispensing system includes a light source and a light sensor positioned on opposite sides of the stream of the beverage. The beverage dispensing system is configured for detecting if dispensement of the beverage is occurring and characterizing the volume or amount of the beverage being dispensed.

18 Claims, 2 Drawing Sheets

STREAM DETECTION AND/OR CHARACTERIZATION FOR BEVERAGE DISPENSING IN A REFRIGERATOR

FIELD OF THE INVENTION

The present invention relates to beverage dispensing. More specifically, but not exclusively, the present invention relates to a beverage dispensing system of a refrigerator having stream detection and/or characterization.

BACKGROUND OF THE INVENTION

Beverage dispensing systems of various types exist. Of particular interest is refrigerators with beverage dispensing systems that allow for beverages to be prepared. Yet problems remain. One problem is that although ac actuator or other control devices may be energized to initiate a dispensement, the dispensement may not occur as intended or the beverage being dispensed may not be the beverage intended either because it is a different type of beverage or a different strength of beverage. This may occur, for example, if a pump is fully or partially clogged or because the chemistry is depleted (such as if no beverage mix is available). Any of these types of problems may be frustrating and inconvenient for a user to diagnose and correct.

What is needed is a refrigerator with a beverage dispensing system which can detect whether a stream of beverage is present and/or characterize the stream being dispensed or provide other functionality which can be used to monitor the dispensement of beverages.

BRIEF SUMMARY OF THE INVENTION

According to one aspect of the present invention a refrigerator is provided. The refrigerator includes a refrigerator cabinet and a refrigerating compartment within the refrigerator cabinet. There is a beverage dispensing system operatively connected to the refrigerator cabinet, the beverage dispensing system configured to dispense a stream of a beverage. The beverage dispensing system includes a light source and a light sensor positioned on opposite sides of the stream of the beverage. The beverage dispensing system is configured for detecting if dispensement of the beverage is occurring and characterizing the volume or amount of the beverage being dispensed.

According to another aspect of the present invention, a refrigerator is provided. The refrigerator includes a refrigerator cabinet, a refrigerating compartment within the refrigerator cabinet, and a beverage dispensing system operatively connected to the refrigerator cabinet, the beverage dispensing system configured to dispense a stream of a beverage. The beverage dispensing system includes an optical sensing device positioned proximate the stream of the beverage and the beverage dispensing system configured to detect if dispensement of the beverage is occurring and to characterize an amount of the beverage being dispensed.

According to another aspect of the present invention, a refrigerator is provided. The refrigerator includes a refrigerator cabinet, a refrigerating compartment within the refrigerator cabinet, and a beverage dispensing system operatively connected to the refrigerator cabinet, the beverage dispensing system configured to dispense a stream of a beverage. The beverage dispensing includes an optical sensing device positioned proximate the stream of the beverage and the beverage dispensing system configured to detect if dispensement of the beverage is occurring, to characterize an amount of the beverage being dispensed, and to characterize a type of the beverage being dispensed.

According to another aspect of the present invention, a method of monitoring a beverage dispensing system of a refrigerator is provided. The method includes initiating dispensement of a stream of a beverage from the beverage dispensing system of the refrigerator. The method further includes optically sensing properties associated with the stream of the beverage being dispensed from the beverage dispensing system of the refrigerator, and then characterizing an amount of the beverage being dispensed and a type of the beverage being dispensed based on the properties associated with the stream.

DETAILED DESCRIPTION OF THE PREFERRED EMBODIMENTS

Figure 1:
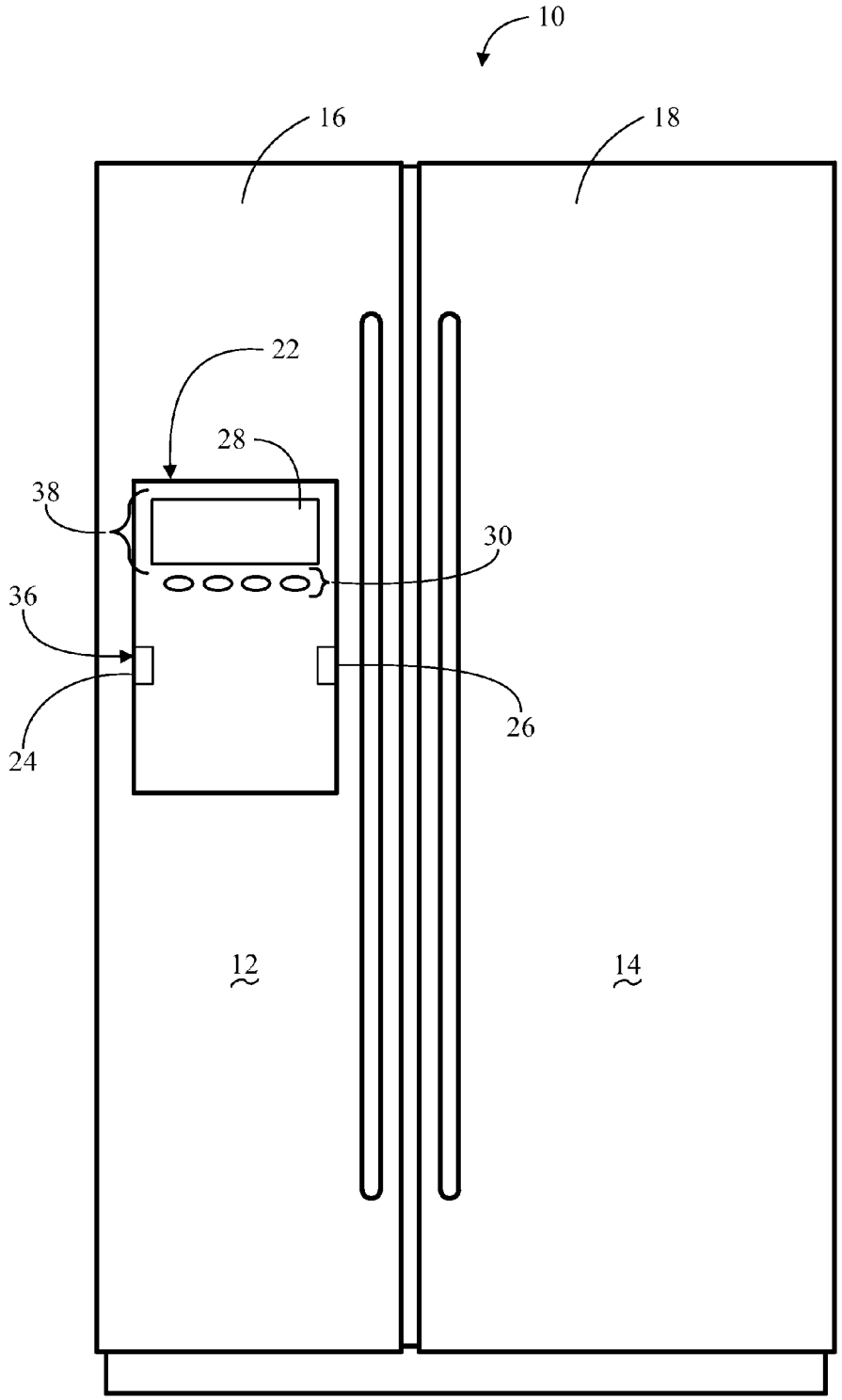
FIG. 1 illustrates a refrigerator with a beverage dispensing system.

FIG. 1 illustrates a refrigerator 10 having a fresh food compartment 14 and a freezer compartment 12. The fresh food compartment 14 has a door 18 and the freezer compartment 12 has a door 16. The refrigerator 10 includes a beverage dispensing system 22 which is shown in the door 16. The refrigerator 10 also includes an optical sensing device or system 36. The optical sensing device or system 36 may include a light source 24 and a light sensor 26 associated with the beverage dispensing system 22. Although the light source 24 and light sensor 26 are shown in a particular position, positions of the light source 24 and light sensor 26 may be reversed or otherwise moved. The refrigerator 10 also includes a user interface 38 which may, for example, include a display 28 and manual user input buttons 30. As shown in FIG. 1, the refrigerator 10 is shown in a side-by-side configuration. Of course, the refrigerator 10 may take on other configurations as well, such as a bottom mount freezer configuration.

Figure 2:
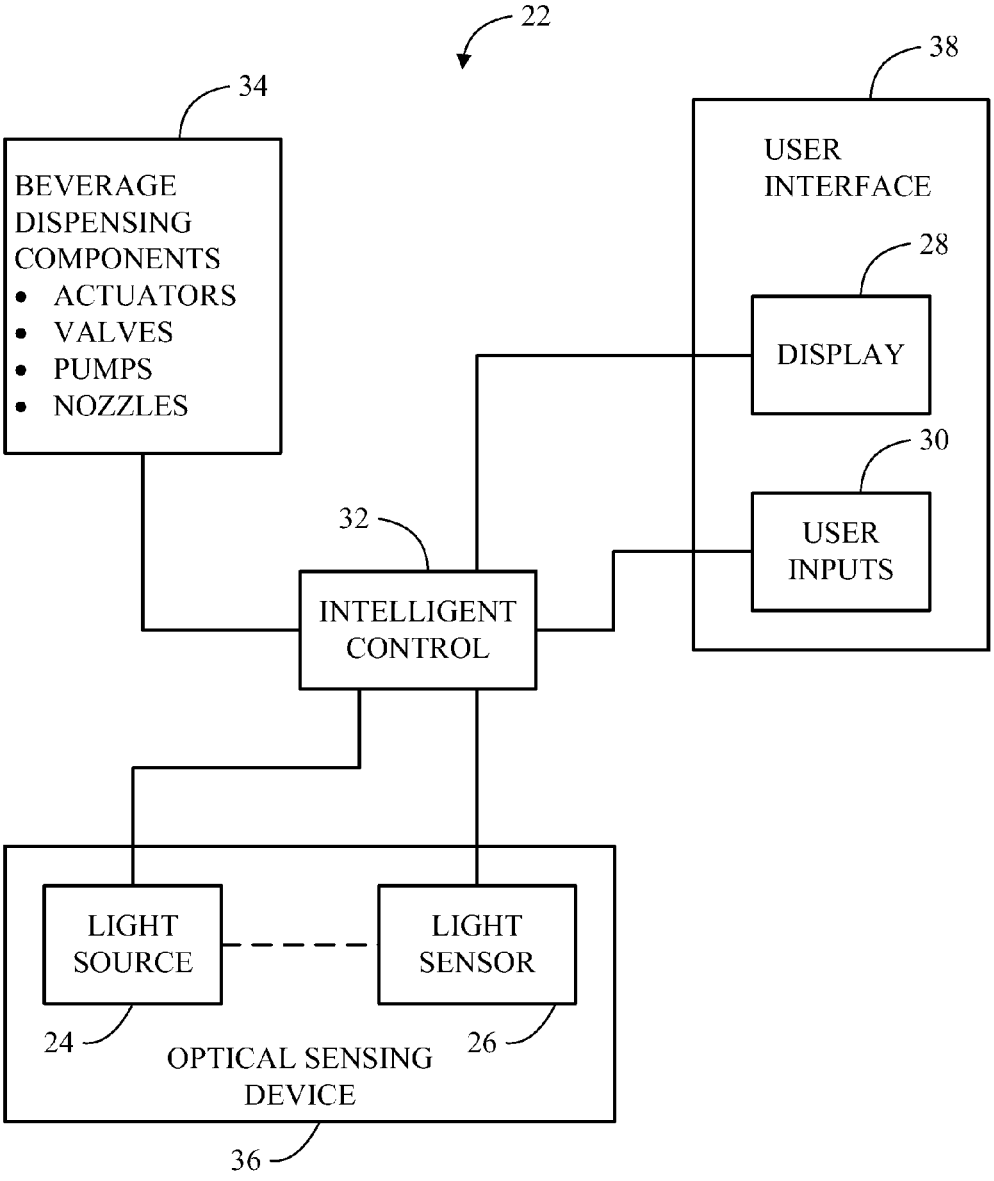
FIG. 2 illustrates a block diagram representation of a beverage dispensing system of a refrigerator.

FIG. 2 illustrates a block diagram representation of a beverage dispensing system 22. The beverage dispensing system 22 may include beverage dispenser components 34. The beverage dispenser components 34 may include actuators, valves, pumps and nozzles to allow the chosen beverage (colas, sparkling water, iced tea, lemonade, fruit punch, hot chocolate, hot tea, coffee, milk, water, hot water, etc.) to dispense into a consumer's chosen container (cup, glass, mug, etc). The beverage dispensing system 22 may also dispense ice cubes and or crushed ices.

As shown in FIG. 2, an intelligent control 32 is electrically connected to an optical sensing device or system 36. The optical sensing device 36 may include the light source 24 and the light sensor 26. The intelligent control 32 is also electrically connected to a user interface 38 which may include a display 28 and user inputs 30. The user interface 38 may provide for interacting with a user through any number of ways including through the use of a touch screen display, the use of audio, and in other ways. In operation, the beverage dispensing system 22 is configured to dispense a stream of beverage. The light source 24 and light sensor 26 may be positioned on opposite sides of the stream of beverage. By monitoring the light sensor 26, the beverage dispensing system may determine or detect if dispensement of the beverage is occurring. For example when light is being emitted from the light source 24 to the light sensor 26 and light is not being received at the light sensor then the absence of light being received may be indicative of the beverage stream being present. For example, after the intelligent control 32 activates actuators associated with dispensement, the intelligent control may expect to detect an interruption in the light associated with the beverage dispensement. If the interruption occurs at the expected time and for the expected duration, then this information is indicative that the desired dispensement was performed. If an interruption occurs at other than the expected time or for a duration other than the expected duration, then this information may be indicative of a problem or issue with the dispensement process which the user should be warned of or for which corrective action should be performed. For example, if a pump associated with dispensement is not fully operational (such as if fully or partially clogged), then proper dispensement does not occur. Similarly, if an interruption occurs at other than the expected time, this may be as a result of leakage which should not be occurring.

In addition, the beverage dispensing system may otherwise characterize the beverage being dispensed. For example, the beverage dispensing system may characterize the volume of amount of beverage being dispensed. Although, the present invention contemplates that such a characterization may be performed in various ways, one method is to determine a length of time that a beverage stream is present and then based on the length of time determine an amount or volume of beverage being dispensed. The intelligent control 32 may use mathematical relationships or look-up tables to determine the amount of beverage being dispensed based on the time as well as other beverage parameters. Examples of other beverage parameters may include, without limitation, type of beverage being dispensed, valve settings, nozzle settings, pump settings, and other parameters that may affect the volume or the amount of beverage dispensed.

In addition, the beverage dispensing system may detect optical characteristics associated with the beverage. By detecting indicia of color or opacity of the beverage being dispensed additional information about the beverage being dispensed is acquired. This may include the type of beverage, the strength of beverage, or other characteristics of the beverage. Various types of measurements may be taken including through direct transmission, reflectance, or measuring the effect of fluid on a surface. In one embodiment, a translucent element may be placed between the light source and light sensor such as described in U.S. Pat. No. 6,924,499, herein incorporated by reference in its entirety. Of course, other types of optical systems may be used as may be more appropriate in a particular environment or application.

Thus, once dispensement of a beverage is initiated, the beverage dispensing system may determine whether or not dispensement is, in fact occurring, whether the amount of beverage being dispensed is the intended amount or not, as well as other information which may be derived from detected optical properties of the beverage. This may include type of beverage or strength of beverage. For example, if a soda is being dispensed which should be dark brown in color and the optical properties measured indicate the beverage being dispensed is the color of water, then the beverage dispensing system may determine that what is being dispensed is not what the user intended to dispense. In such an instance, the refrigerator may alert the user such as by providing an appropriate message on a display of the refrigerator, providing an audible alert, or otherwise using a user interface associated with the refrigerator to alert the user.

Therefore, a refrigerator with a beverage dispensing system has been disclosed. The present invention contemplates numerous variations, options, and alternatives.

What is claimed is:

1. A refrigerator, comprising:

a refrigerator cabinet;

a refrigerating compartment within the refrigerator cabinet;

a beverage dispensing system having a beverage dispensing area configured to receive a container, the beverage dispensing system operatively connected to the refrigerator cabinet and configured to dispense a stream of a beverage;

the beverage dispensing system comprising a light source and a light sensor positioned on opposite sides of the stream of the beverage within the beverage dispensing area, wherein light from the light source is directed through the stream of the beverage and to the light sensor to measure optical properties of the beverage after the beverage has been dispensed into the beverage dispensing area, wherein the beverage dispensing system configured to detect if dispensement of the beverage is occurring and to characterize an amount of the beverage being dispensed by monitoring the light sensor;

a user interface operatively connected to the beverage dispensing system above the dispensing area and wherein the beverage dispensing system being further configured to use the user interface to provide feedback to a user on the beverage being dispensed based on the optical properties associated with the beverage being dispensed; and an alert for informing the user when the beverage dispensing system dispenses a beverage that is not what the user intended to be dispensed.

2. The refrigerator of claim 1 wherein the beverage dispensing system further provides for detecting color of the beverage.

3. The refrigerator of claim 1 further comprising an intelligent control operatively connected to the light source and the light sensor and programmed for detecting if dispensement of the beverage is occurring and characterizing the amount of the beverage being dispensed.

4. The refrigerator of claim 3 further comprising a display operatively connected to the intelligent control and wherein the intelligent control is configured for displaying a message on the display associated with the beverage being dispensed.

5. The refrigerator of claim 1 wherein the light source comprises a light emitting diode (LED).

6. The refrigerator of claim 1 wherein the beverage dispensing system being further configured to characterize a type of beverage being dispensed.

7. The refrigerator of claim 1 wherein the beverage dispensing system being further configured to characterize a strength of beverage being dispensed.

8. The refrigerator of claim 1 wherein the beverage dispensing system being further configured to evaluate optical properties associated with the beverage being dispensed.

9. The refrigerator of claim 8 wherein the beverage dispensing system being further configured to determine a type of beverage based on the optical properties.

10. The refrigerator of claim 8 wherein the beverage dispensing system being further configured to determine a strength of beverage based on the optical properties.

11. A refrigerator, comprising:

a refrigerator cabinet;

a refrigerating compartment within the refrigerator cabinet;

a beverage dispensing system operatively connected to the refrigerator cabinet, the beverage dispensing system configured to prepare and dispense a stream of a beverage;

the beverage dispensing system comprising an optical sensing device positioned proximate the stream of the beverage and the beverage dispensing system configured to detect if dispensement of the beverage is occurring, to characterize an amount of the beverage being dispensed, and to characterize optical properties of the beverage detected with the optical sensing device after the beverage is dispensed from the beverage dispensing system; and a display operatively connected to an intelligent control and wherein the intelligent control is configured for displaying an alert on the display for informing a user when the beverage dispensing system dispenses a beverage that is not what the user intended to be dispensed.

12. The refrigerator of claim 11 wherein the beverage dispensing system further provides for detecting color of the beverage.

13. The refrigerator of claim 11 further comprising an intelligent control operatively connected to a light source and a light sensor and programmed for detecting if dispensement of the beverage is occurring and characterizing the amount of the beverage being dispensed.

14. The refrigerator of claim 13 wherein the light source comprises as light emitting diode (LED).

15. The refrigerator of claim 11 wherein the beverage dispensing system being further configured to characterize a type of beverage being dispensed.

16. The refrigerator of claim 11 wherein the beverage dispensing system being further configured to characterize a strength of beverage being dispensed.

17. A refrigerator, comprising:

a refrigerator cabinet;

a refrigerating compartment within the refrigerator cabinet;

a beverage dispensing system operatively connected to the refrigerator cabinet, the beverage dispensing system configured to prepare and dispense a stream of a beverage;

the beverage dispensing system comprising an optical sensing device positioned proximate the stream of the beverage and the beverage dispensing system configured to detect if dispensement of the beverage is occurring, to characterize an amount of the beverage being dispensed, and to characterize a type of the beverage being dispensed based on optical properties of the beverage as measured by the optical sensing device after the beverage is dispensed; and a display operatively connected to an intelligent control and wherein the intelligent control is configured for displaying an alert on the display for informing a user when the beverage dispensing system dispenses a beverage that is not what the user intended to be dispensed.

18. A method of monitoring a beverage dispensing system of a refrigerator, the method comprising:

providing a refrigerator, the refrigerator comprising (a) a refrigerator cabinet, (b) a refrigerating compartment within the refrigerator cabinet, (c) a beverage dispensing system operatively connected to the refrigerator cabinet, the beverage dispensing system configured to prepare and dispense a stream of a beverage, (d) the beverage dispensing system comprising a light source and a light sensor positioned on opposite sides of the stream of the beverage such that light from the light source is directed through the stream of the beverage and to the light sensor and the beverage dispensing system configured to detect if dispensement of the beverage is occurring and to characterize an amount of the beverage being dispensed, and (e) an intelligent control associated with the beverage dispensing system and operatively connected to the light source and the light sensor;

initiating dispensement of the stream of a beverage from the beverage dispensing system of the refrigerator;

optically sensing properties associated with the stream of the beverage after being dispensed from an outlet in the beverage dispensing system of the refrigerator using the light sensor;

characterizing an amount of the beverage being dispensed and a type of the beverage being dispensed based on the properties associated with the stream using the intelligent control;

providing feedback to a user on the beverage being dispensed based on optical properties associated with the beverage being dispensed; and alerting the user when the beverage dispensing system dispenses a beverage that is not what the user intended to be dispensed.

* * * * *